US007699066B2

(12) United States Patent
Andersen et al.

(10) Patent No.: US 7,699,066 B2
(45) Date of Patent: Apr. 20, 2010

(54) DEVICE FOR CLEANING SUBSEA SURFACES SUCH AS SHIP HULLS

(75) Inventors: Robert Andersen, Notodden (NO); Thor Olay E. Sperre, Notodden (NO)

(73) Assignee: Cleanhull Norway AS, Notodden (NO)

( * ) Notice: Subject to any disclaimer, the term of this patent is extended or adjusted under 35 U.S.C. 154(b) by 866 days.

(21) Appl. No.: 10/578,622

(22) PCT Filed: Nov. 10, 2004

(86) PCT No.: PCT/NO2004/000339

§ 371 (c)(1),
(2), (4) Date: May 8, 2006

(87) PCT Pub. No.: WO2005/044657

PCT Pub. Date: May 19, 2005

(65) Prior Publication Data

US 2007/0051392 A1 Mar. 8, 2007

(30) Foreign Application Priority Data

Nov. 10, 2003 (NO) ..... 20034978

(51) Int. Cl.
*B08B 3/02* (2006.01)
*B63B 59/08* (2006.01)

(52) U.S. Cl. ..... 134/123; 134/172; 134/180; 134/191; 239/237; 239/246; 114/222

(58) Field of Classification Search ..... 134/123, 134/168 R, 172, 174, 180, 187, 189, 191; 239/237, 246, 251, 261, 264; 114/222
See application file for complete search history.

(56) References Cited

U.S. PATENT DOCUMENTS

| | | | | | |
|---|---|---|---|---|---|
| 3,420,444 | A | * | 1/1969 | Ajnefors | 239/227 |
| 3,829,019 | A | | 8/1974 | Petsch | |
| 3,946,692 | A | * | 3/1976 | Sierra et al. | 114/222 |
| 4,314,521 | A | * | 2/1982 | Lundberg | 114/222 |
| 4,574,722 | A | * | 3/1986 | Orita et al. | 114/222 |
| 4,604,960 | A | * | 8/1986 | Wachi | 114/222 |

(Continued)

FOREIGN PATENT DOCUMENTS

| | | |
|---|---|---|
| EP | 1216761 | 6/2002 |

(Continued)

*Primary Examiner*—Joseph L Perrin
(74) *Attorney, Agent, or Firm*—Dennison, Schultz & MacDonald

(57) ABSTRACT

Device for cleaning of surfaces under water, such as ship hulls, includes a rotary disc furnished with nozzles for discharge of pressurized liquid against the surface to be cleaned. The nozzles are mounted obliquely in relation to the rotational axis of the rotary disc and are arranged to be supplied with pressurized liquid through a hollow spindle that is concentric with the rotational axis. The nozzles have an inclination that have an orientation involving that the velocity component ($V_p$) of the liquid jet from each nozzle that is not perpendicular to the surface to be cleaned, has a tangential velocity component ($V_t$) that has the same direction as the direction of rotation (R) of the rotary disc and optionally a radial velocity component that is positive, i.e. that is directed outwards in relation to the center of the disc.

16 Claims, 3 Drawing Sheets

U.S. PATENT DOCUMENTS

Figure 1:
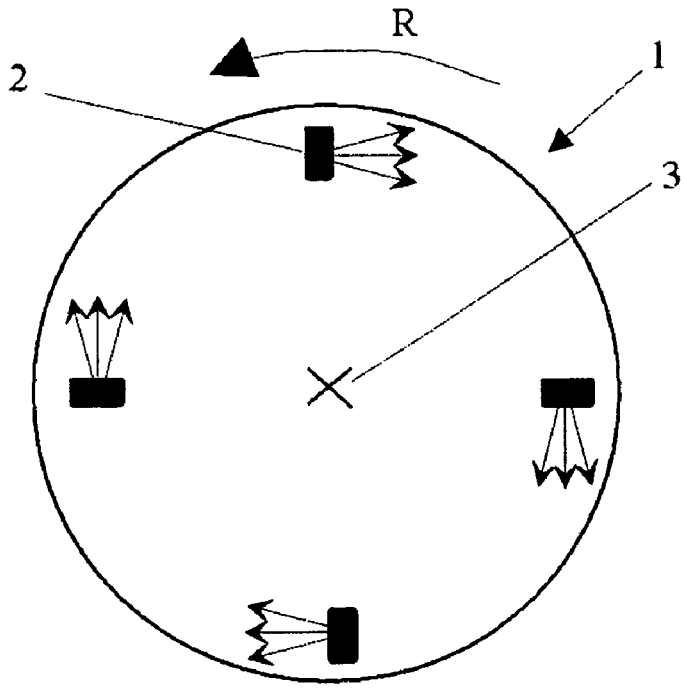
PRIOR ART Figure1

| | | | | |
|---|---|---|---|---|
| 4,838,193 | A * | 6/1989 | van der Tak | 114/222 |
| 4,926,775 | A | 5/1990 | Andorsen | |
| 5,048,445 | A | 9/1991 | Lever et al. | |
| 5,884,642 | A | 3/1999 | Broadbent | |
| 6,425,340 | B1 | 7/2002 | McGuire | |

FOREIGN PATENT DOCUMENTS

| | | |
|---|---|---|
| NO | 310902 | 5/2001 |
| RU | 2122961 | 12/1998 |

* cited by examiner

DEVICE FOR CLEANING SUBSEA SURFACES SUCH AS SHIP HULLS

This application is a filing under 35 USC 371 of PCT/NO2004/000339, filed Nov. 10, 2004.

BACKGROUND OF THE INVENTION

The present invention concerns a device for cleaning surfaces, particularly large surfaces that have at least partly limited availability for conventional methods of cleaning, including ship hulls and the like.

It is a considerable challenge to develop equipment for large surfaces such as ship hulls, partly due to their limited availability being partly submerged in water. On the other hand, due to fouling of the surfaces with marine organisms that make the surfaces rough and not smooth, a rather frequent cleaning is required. A ship hull covered with layers of such organisms will have a significant increase in fuel consumption as a result of the increased friction between the hull and the water. In this connection it should be noted that an increase in friction of 1% leads to an increase in fuel consumption of 3%.

Furthermore ship hulls are commonly coated with toxic ship-bottom paints containing organic tin compounds that it is highly desired remain in place during the cleaning operation, as it else will lead to poisoning of marine organisms. It is thus a challenge to develop equipment that removes impurities from the surfaces but that does not or to only a limited extent damage any layers of ship-bottom paints present.

Norwegian patent No. 310 902 (Andorsen) describes a cleaning apparatus for marine constructions, primary closing nets and fish farming net cages. The apparatus comprises a rotary disc provided with nozzles along the disc periphery. The disc is suspended in a line arranged to be moved mainly vertically along a vertical surface to be cleaned. By directing the nozzles with a certain inclination a so-called "foil" effect is obtained, which is understood to mean a kind of attraction between the disc and the surface to be cleaned.

Norwegian patent No. 313 746 (Andorsen) describes a cleaning apparatus for marine constructions, mainly ship hulls, offshore construction, fish farming plants, and the like. The apparatus comprises nozzles arranged on rotor members and a cleaning unit typically comprises three or five such rotor members. The main unit is suspending by a wire, chain or the like. According to the patent it is important to reduce the size of the rotor members that typically have a diameter less than 25 cm, to thereby increase their speed, which is assumed to lead to an improved cleaning effect at a given water pressure. From this it seems to be clear that the water pressure provides the driving force for the rotor members. An operational pressure of 200 to 250 bars is mentioned.

U.S. Pat. No. 3,946,692 concerns a device for cleaning of surfaces under water provided with wheels, having cleaning members comprised by circularly, rotary brushes arranged in a manner to be create an attraction force between the brushes and the surface. The device typically has three brushes and the attraction force per brush is said to be about 220 kg, i.e. abut 660 kg for the entire device/vehicle. The brushes are powered by separate hydraulic motors and the rotary speed is typically between 700 and 1200 rpm. The brush diameter is typically 400 mm. There is no mention of supply of pressurized water in this patent.

U.S. Pat. No. 4,574,722, like U.S. Pat. No. 3,946,692, concerns a "vehicle" provided with brushes to clean surfaces such as ship hulls under water. A drawing shows that a little surface vehicle is intended to act as a "buoy" for the vehicle when the latter is moved along a vertical surface of a ship. An important feature of this device is the fact that each brush has a flexible suspension mechanism that shall ensure good cleaning even when the surface to be cleaned is not flat. The vehicle also comprises a buoyancy tank.

U.S. Pat. No. 4,926,775 also concerns a cleaning device intended for use on mainly vertical surfaces under water. The apparatus comprises a set of nozzles (or at least one nozzle) arranged to spray water under high pressure against a surface, the nozzles being arranged on (at least) one rotary disc, the rotational axis of which is mainly perpendicular to the surface to be cleaned. It is particularly pointed out that the nozzles are obliquely arranged to provide the spraying water with a tangential motion component, leading to a reactive force that sets the disc in rotation. In addition one or more of the nozzles are directed away from the surface to be cleaned in order to maintain the apparatus in a position close to the same surface.

U.S. Pat. No. 5,884,642 concerns a movable vehicle for cleaning of metallic surfaces such as ship hulls by application of pressurized water. The movement is conducted by means of cog wheels and chains comprising magnetic elements or sections. The patent is largely occupied with the individual control of the wheels to provide the vehicle with a convenient movability/maneuverability. Cleaning nozzles are distributed along a rotation symmetrical central arm under the vehicle, said arm being arranged to pivot around a central axis (48) through which the water is supplied, such that the nozzles draw circles with different radii. Nothing in this patent indicates that the arm may rotate against the direction of obliquely arranged nozzles, and it is therefore assumed that the mechanism for rotation is the same as described in U.S. Pat. No. 4,926,775.

U.S. Pat. No. 6,425,340 concerns a device for cleaning surfaces under water, utilizing a permanent magnet to attach the device to e.g. a ship hull or the like. The cleaning device comprises an "ultra-high pressure water jet system" and is intended to remove also "coatings" like paint etc. A water pressure of 25 000 psi or 1725 bar is indicated and the system comprises at least one pivotal nozzle. Furthermore the device includes a surrounding sheath that covers the area around the nozzle orifices tightly against the hull in order to collect material that comes loose, so that it does not get lost to the environment. It is worth noticing that the nozzle or nozzles according to this publication are rotating around themselves, they are not mounted on a rotating disc. This feature is evident e.g. by FIG. 5 (rotary part 32) and by column 9, lines 15-16 and lines 30-33 of the description. This publication by the way provides a broad reference to prior art publications in the area.

U.S. Pat. No. 5,048,445 concerns a device for the same purpose as the publications discussed above, and describes "Thruster assemblies" for propulsion of the device/vessel. The nozzles are arranged on one or more manifold(s) that in certain embodiments may have the shape of a rotatable ring. It is mentioned, cf. col. 9, lines 23-35, that the nozzles for this purpose are obliquely arranged, so that the counter force from the water leaving the nozzles under a high pressure, sets the ring shaped manifold supporting the nozzles in rotation with a rotational speed of typically 90 rpm.

There are also a number of cleaner devices for land based purposes with a rotary head for water flushing or spraying, like the one described in U.S. Pat. No. 3,829,019. This patent describes an apparatus for cleaning of floors and walls and comprises a housing that covers rotating arms furnished with water channels and nozzles for discharging water under pressure against a surface in the form of wall, a floor (terrace) or the like. The rotation of the arms is provided by means of obliquely arranged nozzles on the arms but some of the nozzles may also be directed obliquely in the opposite direction of the rotation powering nozzles. While the nozzles determining the direction of rotation have an angle typically 30° "backwards", the oppositely oblique nozzles have an inclination typically 15° forward. With the presumption that the backward pointing nozzles are not fewer than the forward pointing nozzles, the sum of the force components of the former in the direction of rotation will be larger than the sum of force components of the latter, since the former has a direction closer to the direction of rotation. The force components of the forward pointing nozzles do, however, reduce the rotation to a speed less than what would have been obtained if such nozzles were not present. The apparatus according to this US patent is not suited for cleaning surfaces under water, since the rotating arms provided with nozzles are localized in a substantially open construction and would be surrounded by water that would drastically reduce the arms ability to rotate if the apparatus is submerged in water.

U.S. Pat. No. 4,314,521 teaches an apparatus and a method for cleaning surfaces under water. The apparatus comprises both brush and nozzles attached to a member arranged to rotate and it is mentioned that the rotation may either be effected by means of obliquely arranged nozzles or by means of e.g. hydraulic motors. The apparatus is mainly intended to be controlled by divers and nothing specifically is said about the arrangement of the nozzles apart from the obvious that they must be oblique in the cases where they are to effect the rotation. Liquid is provided from a pump under the surface and in addition the apparatus needs supply of air from the surface to rotate sufficiently easy. The rotating member is hidden beneath a housing that covers all sides of the brush and the member furnish with nozzles, except the side facing the surface to be cleaned.

In short a number of devices for cleaning surfaces like ship hulls and the like comprising both use of brushes and spraying with pressurized water through nozzles. Among the devices based on nozzles some have nozzles arranged on members arranged for rotation, some with nozzles on an arm, some with nozzles on a ring shaped member and some with nozzles arranged on a "whole" disc.

It is a significant challenge to provide a sufficient cleaning of fouled surfaces of a ship hull without damaging or removing parts of the ship-bottom paints applied to the hull. At the same time it is a considerable challenge when transferring liquid under high pressure to a high-speed rotation disc or the like, to establish a liquid coupling that is reliable and leakage free over a longer period of time.

SUMMARY OF THE INVENTION

It is thus an object of the present invention to provide a device for mechanical cleaning of surfaces under water, particularly surfaces fouled with marine organisms that are difficult to remove, such as ship hulls etc.

It is a further object of the invention to provide a device as mentioned above, that is able to clean surfaces treated with paint/ship-bottom paint, without inflicting measurable damages to the paint/ship-bottom paint and thereby inflicting an undesired strain on the environment.

It is a particular object of the invention to provide a device for cleaning of surfaces which is suitable for being carried by an unmanned submarine, a so-called ROV, and that is largely capable of sticking to the surface to be cleaned even when this is substantially vertical.

It is a further object of the invention to provide a device for effective cleaning of fouled or heavy contaminated surfaces by applying water under pressure, b which the cleaning effect in a simple manner may be optimized for a certain water pressure.

Preferred embodiments of the invention are disclosed by the dependent claims.

As discussed there are several prior art cleaning devices based on rotary discs with obliquely arranged nozzles. Common for these constructions is the utilization of the counter force to the water jets from the nozzles, or more precisely of the velocity component of the water jets from the nozzles that is not parallel to the rotational axis of the rotary disc, that provides the rotation to the disc. The solution according to the prior art technology is simple to carry out but implies that a substantial amount of the theoretically available cleaning force is used to turn the disc. In addition the rotational speed is determined solely by the water pressure, so these systems lack the possibility of an individual control of the speed according to the conditions.

The speed V of a water jet leaving an obliquely arranged cleaning nozzle may be seen as the vector sum of a velocity component $V_n$ perpendicularly to the rotary disc and a velocity component $V_p$ parallel to the rotary disc (its rotational plane).

The parallel velocity component $V_p$ may again be seen as the sum of a velocity component $V_r$ that is radial in relation to the rotary disc and a velocity component $V_t$ that is tangential to the rotary disc, or more precisely to the imaginary circular line, concentrically with the rotary disc, that each cleaning nozzle is localized on.

Since relatively high rotational speeds are required, the outer shape of the rotational member (the rotary disc) of to the present invention should cause as low friction from the surrounding water as possible. This is obtained by a shape that is as homogenous as possible across the direction of rotation. More technically this may be expressed this way: The rotational member should have a shape that is such that arbitrary radial sections therethrough have substantially equal shape and size.

While prior art devices comprising rotary discs for cleaning surfaces under water mainly have used obliquely directed nozzles for turning the discs, the device according to the present invention is provided with a separate powering source that coercively powers the discs at desired speed. By the prior art devices the rotational speed is thus limited e.g. by the water pressure and by the aforementioned tangential velocity component must be directed opposite to the direction of rotation. Indeed, all the cleaning nozzles do not have to be equally oriented, but for each cleaning nozzle having the opposite, tangential inclination, the rotational speed will be reduced when the cleaning nozzles provide the rotation of the rotary disc. With the present invention more than half of the cleaning nozzles have such a tangential inclination that the tangential velocity component $V_t$ has the same direction as the direction of rotation R for the rotary disc, without compromising the rotational speed. In this manner an unsurpassed cleaning effect is achieved at a certain water pressure. Preferably a vast majority or all of the cleaning nozzles are arranged such that the tangential velocity component $V_t$ of the water discharged therefrom, has the same direction as the direction of rotation R for the rotary disc. By the present invention the oblique orientation of the cleaning nozzles may be optimized for the purpose of achieving a best possible cleaning effect, as the rotation is maintained in another manner. Thereby an optimal cleaning effect is obtained at a certain supplied water pressure, which implies that extremely high water pressures are not required to achieve the desired effect, which in turn has a positive effect on the lifetime of the components, like spindles and gaskets ensuring liquid tight transfer of liquid between stationary and rotary parts of the device.

An additional advantage of the device according to the invention is the occurrence of a strong suction force between the rotation member, or more precisely the central areas of this, and the surface to be cleaned. This suction force completely counteracts the "recoil" of the water being discharged from the cleaning nozzles at high speed. Thus it is not required to use extra energy to hold the device closely adjacent to e.g. a ship hull when it is cleaned.

It is furthermore preferred that a substantial number of the cleaning nozzles have such an inclination that the radial velocity component $V_r$ of the water being discharged from the cleaning nozzles, are larger than zero, i.e. that there is a velocity component directed outwards from the imaginary circle, concentric with the rotary disc, that each respective cleaning nozzle is localized at.

BRIEF DESCRTION OF THE DRAWINGS

Figure 2A:
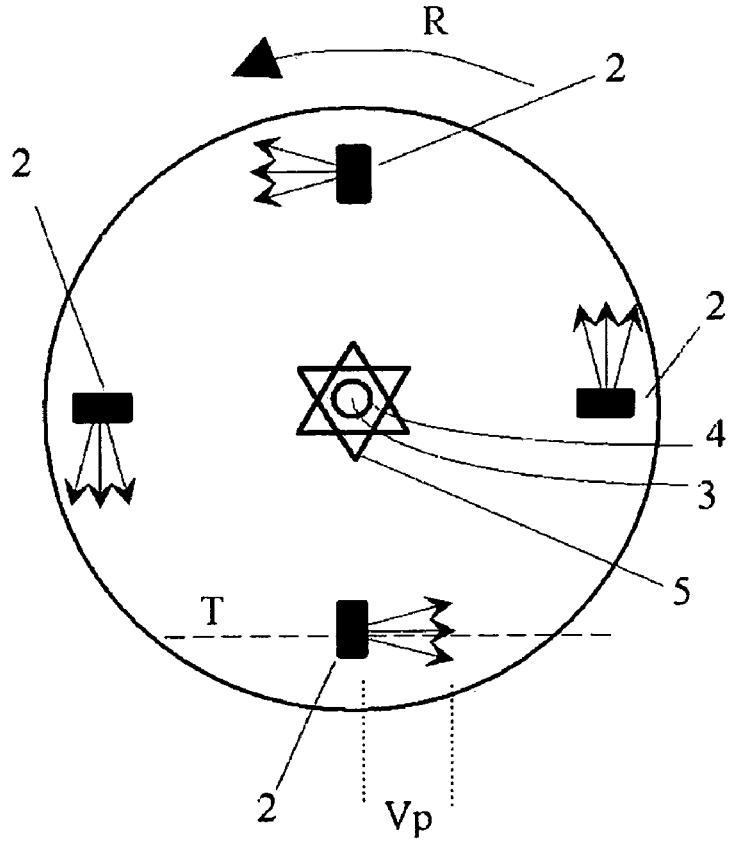
Figure 2B:
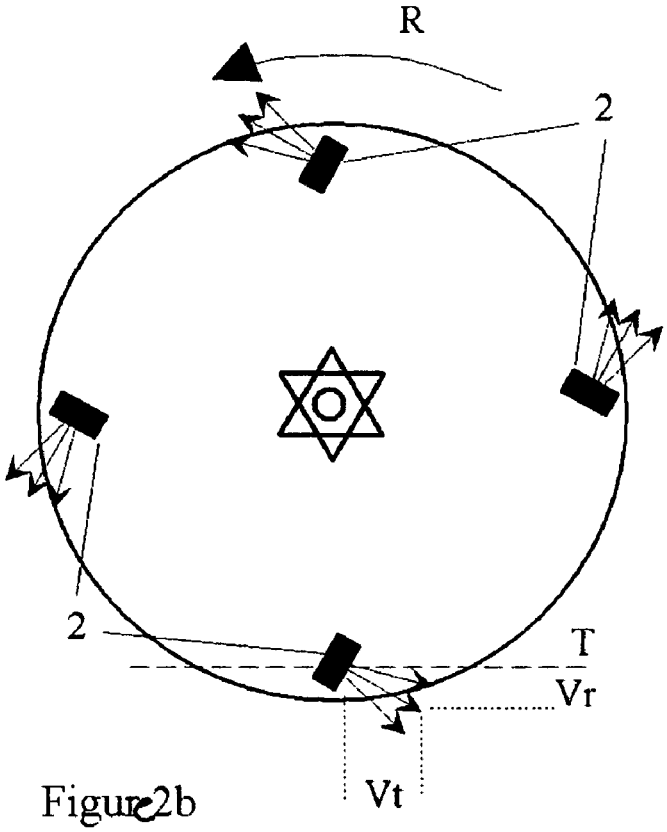
Figure 3:
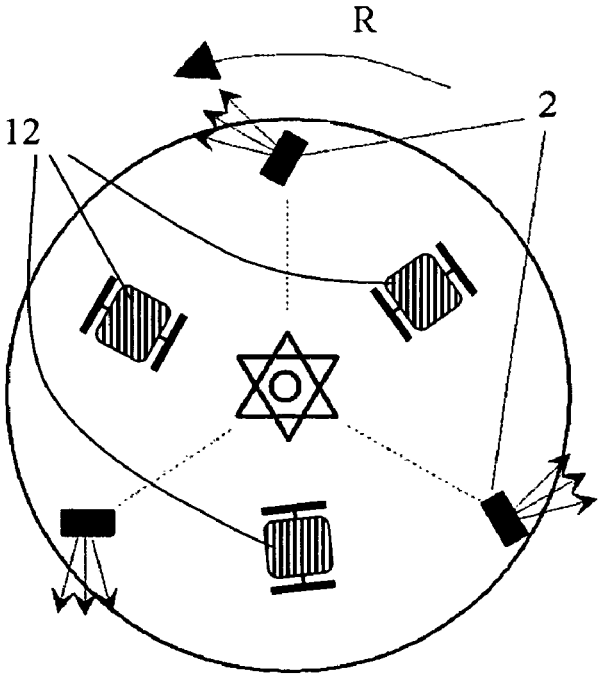
Figure 4:
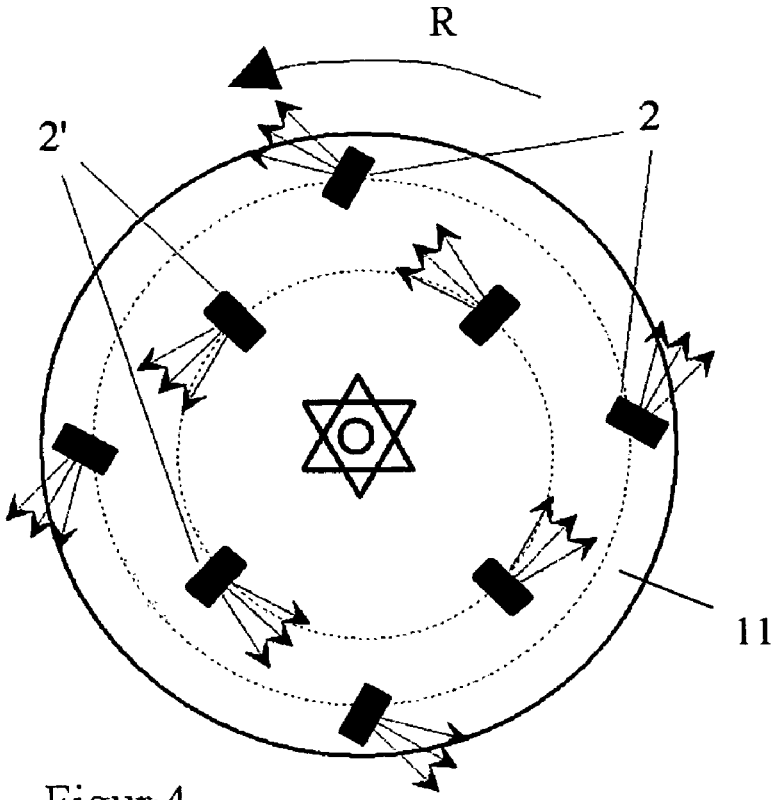
Figure 5:
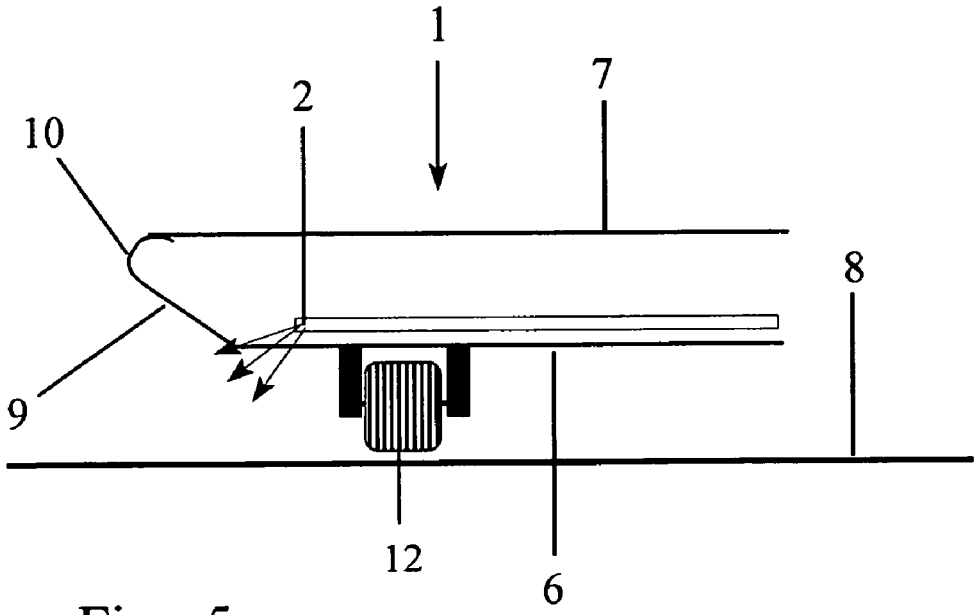

FIG. 1 is a schematic view of a rotary disc according to prior art technology, FIG. 2*a* is a schematic view of a rotational member provided with cleaning nozzles according to a first embodiment of the present invention, FIG. 2*b* is a schematic view of a rotational member according to a variant of the first embodiment of the present invention, FIG. 3 is a schematic view of a rotational member provided with cleaning nozzles according to another variant of the first embodiment of the invention, FIG. 4 is a schematic view of a rotational member provided with cleaning nozzles according to a second embodiment of the present invention, FIG. 5 is a sectional view of a part of a rotational member according to the embodiment shown in FIG. 2*b*.

DESCRIPTION OF THE PREFERRED EMBODIMENTS

With respect to the reference numerals, principally equal elements have the same number in the different drawings.

FIG. 1 shows a rotary disc according to prior art technology seen along its rotational axis 3. Along the periphery of the rotary disc 1 are arranged four cleaning nozzles 2 that are oriented such that supplied water is discharged in a direction with a velocity component that is mainly parallel with the rotational axis 3, i.e. perpendicularly (up) from the paper plane, and a velocity component that is mainly parallel with the tangent of an imaginary circle at the location of each cleaning nozzle 2. This tangential velocity component is for all cleaning nozzles concerned oriented clockwise (towards right). When water under high pressure is discharged from each of the four cleaning nozzles 2, the cleaning nozzles and thereby the rotary disc to which they are attached, are met with a counter force that turns the disc towards left as shown by the arrow R. Thus the tangential velocity component of the water jet provides rotation to the rotary disc while the velocity component parallel to the rotational axis provides a cleaning pressure on the surface to be cleaned and which will normally be mainly parallel with the rotary disc. The water jet from each of the cleaning nozzles will typically has a certain spread, either conically or preferably fan-shaped, as indicated by the three arrows forming an acute angle "fan".

FIG. 2*a* shows a rotary disc according to the present invention. It has the same basic components as the disc of FIG. 1, but comprises in addition a gear 5 that may be engaged by an external motor, not shown, that is able to turn the disc independent of the water being discharged from the cleaning nozzles 2. Contrary to the cleaning nozzles of FIG. 1 the cleaning nozzles are such oriented that the tangential velocity component from each of the cleaning nozzles is directed counter clockwise. According to the invention the orientation (inclination) of the cleaning nozzles is not an obstacle for a counter clockwise rotation of the rotary disc, i.e. against the force on the rotary disc made up of the sum of the tangential velocity components of the jets from the cleaning nozzles. In FIG. 2 there is an indication of the orientation of the tangent T to the imaginary circle on which the cleaning nozzle in question is localized. As in FIG. 1 the rotary disc according to FIG. 2 has a total of four cleaning nozzles that is mutually spaced 90 degrees apart close to the periphery of the rotary disc. Like the case for the prior art rotary discs the water is supplied to the disc through a hollow spindle arranged concentrically with the rotational axis 3.

In practice the water jet from each cleaning nozzle will have a certain spread, for example fan-shaped or in the form of more or less acute cone. In the Figures this is indicated with small arrows with an acute fan-shape. The direction of the water jets can therefore hardly be defined very precisely. When the direction of such a fan-shaped spray of water herein is compared with e.g. the tangent of the imaginary circle where the nozzle in question is localized, it is understood that it is the central portion of that spray that is basis for the comparison with the tangent, while the more peripheral portions of the same spray necessarily will have somewhat deviant directions. It is shown by FIG. 2*a* that the velocity component $V_p$ that is parallel with the rotary disc also is mainly parallel with the tangent to the imaginary circle concentrically with the rotary disc at which each respective nozzle is attached.

FIG. 2*b* shows a particularly preferred embodiment of the invention, departing from the variant shown in FIG. 2*a* in that the direction of the water jet from each of the nozzles is such that the velocity component $V_p$ that is not perpendicular to the surface to be cleaned, is not parallel with the tangent of the imaginary circle at which the nozzles are attached, but is pointed outwards in relation to the tangent. The velocity component $V_p$ may as shown be decomposed into two velocity components, $V_r$ and $V_t$, where $V_r$ is radial in relation to the rotary disc or the imaginary circle concentrically with the rotary disc at which each respective nozzle is attached, while $V_t$ is tangential in relation to the same circle. Since the rotational member (rotary disc) and thus the nozzles attached to this are at a certain distance, even if close, to the surface to be cleaned, this inclination in relation to the tangent implies that the water jets hit the surface in a circle shaped area having a larger radius than the radius of the rotary disc. This means that the water from the nozzles does not add extra liquid between the rotary disc and the surface to be cleaned and there will therefore not be a local overpressure between the rotary disc and the surface to be cleaned.

FIG. 3 shows a variant of the rotary disc shown in FIG. 2*b*, where the sole difference is that it comprises only three cleaning nozzles and that these therefore are spaced apart with a mutual angular distance of 120 degrees.

FIG. 4 shows a different embodiment, with a rotary disc 11 that has cleaning nozzles 2, 2' distributed along two concentric circular lines, with four nozzles on each circular line. The cleaning nozzles 2' on the inner circular line are displaced by an angle of 45 degrees compared to the nozzles 2 on the outer circular line. The tangential velocity component $V_t$ for the liquid jets from all cleaning nozzles on both circular lines, are counter clockwise. The rotary disc is, as shown by the arrow R, arranged to rotate counter clockwise in the same manner as shown in FIGS. 2*a*, 2*b*, and 3. The nozzles along the outer circle are in the same manner as in FIGS. 2*b* and 3 such oriented that the water being discharged from these will have a radial velocity component $V_r$ larger than zero, i.e. that the water from the nozzles 2 will hit the surface beyond (outwards of) the projection of the circumference of the rotary disc on the surface to be cleaned.

FIG. 5 shows a sectional view of a particularly preferred embodiment of the peripheral part of the rotary disc. The rotary disc 1 is mainly flat on both the side 6 facing the surface 8 to be cleaned and on the side 7 facing away from surface 8. In a narrow area 9 of its periphery the rotary disc has, on the side facing the cleaning surface, a ring shaped area tapered away from the surface 8, and the outer edge 10 of the tapered area is rounded over to the opposite side 7. This design has proven very beneficial in that the rotary disc thereby is provided with a lifting force away from the surface 8 to be cleaned along the periphery, said lift compensating somewhat the strong sectional force that occurs close to the centre of the disc. A certain suction force between the rotary disc and the surface is desired, but it is not desired that this suction becomes so strong that the device holding the rotary disc can not be easily moved along the surface to be cleaned, that typically may be a ship hull. While the rotary disc is shown flat on both sides in FIG. 5, shapes deviating from this may also be used, e.g. with a concave side facing the surface to be cleaned. In any case the shape of the cleaning disc will be mainly even around its entire circumference, so that arbitrary radial sections through the disc will have substantially the same shape and size.

It has been shown through practical tests that the cleaning effect of the device according to the invention is very good even at comparatively low water pressures, such as a water pressure in the range 150 to 1250 bars. It is thus a significant advantage in connection with cleaning of large and heavy contaminated surfaces requiring a significant cleaning effect, to use rotary discs with a rotation that is determined by an external motor compared to a rotation that is induced by the force from the cleaning nozzles. A more preferred water pressure is within the range 250-350 bars.

The primary aspect of the present invention is that an excellent cleaning effect is achieved while maintaining a high degree of freedom with respect to combination of water pressure, inclination of nozzles and rotational speed of the discs for any given cleaning operation. The rotational speed is determined independent of the liquid pressure and independent of the nozzles' inclination. Whether the inclination of the nozzles is altered by means of interchangeable individual nozzles or by replacement of the discs with discs having a fixed, but different orientation of its nozzles, is in this connection of less importance. Both these solutions are within the frame of the invention.

The device according to the present invention is developed for and has its primary utilization for cleaning of ship hulls and primarily the parts of the ship hulls that normally are submerged in water. For this purpose a device according to the invention will typically comprise three or four rotary discs and be attached to an ROV conveniently adapted for the purpose. Typically such an ROV will be bistable and have thrusters that ensure that it in any orientation is able to rest against—or go along—a ship hull while the cleaning is conducted. There are existing ROVs having properties suitable for this purpose so this feature is not part of the present invention.

The device according to the present invention is also well suited for cleaning large surfaces on land and will for such purpose be carried by smaller units that are transported either manually or by means of a separate motor. Under any circumstances it is preferred that the device comprises per se known means for positioning, i.e. to ensure that the rotary discs at all times are held substantially parallel with and at a predetermined distance from the surface to be cleaned. The distance between cleaning nozzle and the surface will be comparatively short, e.g. in the range between 0.3 and 4 cm and more typically between 0.5 and 2 cm.

The equipment for positioning of the rotary discs will typically comprise a frame on which one or more discs are attached and wheels are mounted to the frame or possibly to individual discs, said wheels being adapted during the cleaning operation to rest against the surface to be cleaned. Wheels 12 mounted on a rotary disc 1 are shown in FIGS. 3 and 5. Such positioning equipment is prior art technology and therefore not described in more detail here.

With respect to cleaning of ship hulls it is as mentioned very important that toxic ship-bottom paint on the hull is not damaged. This aspect is exemplified below.

EXAMPLE

Cleaning were performed on test surfaces treated with a tributyltin (TBT) containing antifouling agent. In connection with performance of the tests water to the cleaning nozzles was recycled from/to test vessels, so that dilution of any organic compound introduced in the vessels were avoided. The operation of the rotary discs was however made in another manner which implied a dilution of all concentrations in the vessel by 12 l/minute. This effect, however, only had a 0.35% impact for first test sample and a 1.7% impact for second and third test sample. The test was conducted as shown by table 1 below.

TABLE 1

| Point in time | Sample | Activity | Remarks |
|---|---|---|---|
| 4/Oct-02 | | Positioning of sample plates in test vessel filled with fresh water (1170 litres). A number of 10 steel plates treated with TBT containing anti-fouling | |
| 4-7/Oct-02 | | Leakage of organic tin compounds to water in test vessel | |
| 7/Oct-02 (kl 10:00) | Sample 1 | | Sample of water in test vessel subsequent leakage but prior to first cleaning |

TABLE 1-continued

| Point in time | Sample | Activity | Remarks |
|---|---|---|---|
| 7/Oct-02 (kl 10:30) | | Cleaning process 1. Cleaning rig with 3 rotary discs of a total width 1.2 m. Cleaning of 4 steel plates back and forth - duration ca. 20 seconds. Pressure 170 bar. Rotation 400 rpm. | |
| | Sample 2 | | Sample of water in test vessel subsequent to first cleaning. |
| 7/Oct-02 (kl. 11:00) | | Cleaning process 2. Cleaning rig with 3 rotary discs of a total width 1.2 m. Cleaning of 4 steel plates back and forth - duration ca. 20 seconds Pressure 220 bar. Rotation 500 rpm | |
| | Sample 3 | | Sample of water in test vessel subsequent to second cleaning. |

The chemical compounds analyzed for, the methods of analysis used and the detection limits for the respective compounds, are listed in table 2 below.

TABLE 2

| Chemical compound | Method of analysis | Detection limit |
|---|---|---|
| Tributyltin (TBT) | GC-MS | 0.007 μg/l |
| Dibutyltin (DBT) | GC-MS | 0.005 μg/l |
| Monobutyltin (MBT) | GC-MS | 0.010 μg/l |
| Triphenyltin (TFT) | GC-MS | 0.003 μg/l |

TBT may be decomposed into DBT. MBT and TFT and it is therefore required to analyze all these compounds to obtain a correct picture of total leakage of organic tin compounds during cleaning The results of the leakage analysis are shown in table 3.

TABLE 3

| Sample | | All results in μg/l | | | |
|---|---|---|---|---|---|
| No. | Material | TBT | DBT | MBT | TFT |
| 1 | Sample of water in test vessel prior to first cleaning. | 67 | 9.7 | 12 | n.d. |
| 2 | Sample of water in test vessel subsequent to first cleaning. | 61 | 10 | 21 | n.d. |
| 3 | Sample of water in test vessel subsequent to second cleaning. | 61 | 10 | 16 | n.d. |

(n.d.—not detectable, i.e. less than 0.003 μg/l)

In the table above the dilution effect is not reflected, but as mentioned this is never larger than 1.7%, while the uncertainty factor of the analysis is said to be about 20%.

The analyses do not show any increase in TBT, DBT or TFT either before or after first or second cleaning. The measurements of MBT were not consistent, in that an increase was found from sample 1 to sample 2 while sample 3 showed a lower MBT level than sample 2. Inventor has not immediate explanation to the inconsistent result of MBT, but the measurements as a whole regardless of this give a clear indication that the anti-fouling coating is negligibly affected by the cleaning operations.

Several advantages of the device according to the invention has already been mentioned, and it should particularly be emphasized that the versatility that is achieved by the coercive rotation of the rotary disc allows a significantly larger degree of freedom with respect to choice of inclination of the nozzles to optimize the cleaning effect.

The invention claimed is:

1. Device for cleaning of underwater surfaces, comprising:

a rotary disc member which is constructed and arranged to rotate in a rotational plane and having a rotational axis, the rotary member equipped with a plurality of nozzles for discharging liquid under pressure against the surfaces to be cleaned, said nozzles being arranged along a circular line on a surface of the rotary disc member and being attached to the rotary member obliquely in relation to the rotational axis, such that water jets being discharged from the nozzles will have a velocity component $v_n$ that is perpendicular to the rotational plane of the rotary member and a velocity component $v_p$ that is parallel to the rotational plane of the rotary member;

a hollow spindle concentric with the rotational axis for connection to a source of liquid under pressure to be supplied to said nozzles; and a separate propulsion device for setting the rotary disc member in rotation;

wherein arbitrary radial sections of the rotary disc member are substantially equal in shape and size, wherein the velocity component $v_p$ that is parallel to the rotational plane is the sum of a velocity component $v_r$ that is radial in relation to the rotary disc member and a velocity component $v_t$ that is tangential in relation to the circular line along which the nozzles are arranged, and wherein the separate propulsion device causes rotation of the rotary disc member in a direction in relation to the inclination of the nozzles such that the tangential velocity component $v_t$ for the liquid being discharged from at least half of the nozzles has a direction which is the same as the direction of rotation of the rotary disc member.

2. Device as claimed in claim 1, wherein at least half of the nozzles have an inclination such that the radial velocity component $V_r$ for water being discharged from these nozzles is positive, directed outwards from the circular line, concentric with the rotary disc member.

3. Device as claimed in claim 1, wherein the separate propulsion device comprises a gear mechanism in engagement with external propulsion means.

4. Device as claimed in claim 3, wherein the external propulsion means is a water hydraulic motor.

5. Device as claimed in claim 1, wherein the rotary disc member is flat or concave on a side facing the surface to be cleaned.

6. Device as claimed in claim 1, wherein the rotary disc member has a diameter of 20-50 cm.

7. Device as claimed in claim 1, wherein the rotary disc member is constructed and arranged to turn the rotary disc at an angular speed of 200-700 rpm by external propulsion means.

8. Device as claimed in claim 1, wherein the hollow spindle is connected to a source of liquid at a pressure of 100-500 bars to be supplied to the nozzles.

9. Device as claimed in claim 8, wherein the pressure of the liquid supplied to the nozzles is at a pressure of 250-350 bars.

10. Device as claimed in claim 1, wherein at least two nozzles are arranged along a common circular line with a center at the rotational axis and the nozzles are distributed angularly symmetrically along said common circular line.

11. Device as claimed in claim 10, wherein the rotary disc has at least two circular lines along which nozzles are arranged with angular symmetry.

12. Device as claimed in claim 1, additionally comprising spacing elements constructed and arranged to ensure that the rotary disc is at all times held parallel to the surface to be cleaned and at a predetermined distance from the surface to be cleaned.

13. Device as claimed in claim 12, wherein said spacing elements are wheels.

14. Device as claimed in claim 12, wherein the spacing elements are constructed and arranged to hold the rotary disc in a position where the distance between the surface to be cleaned and the nozzles is 0.5-2 cm.

15. Device as claimed in claim 1, wherein the nozzles are constructed and arranged to provide conical water jets that strike the surface to be cleaned in areas that in dependence on the inclination of the nozzles are substantially circular or elliptic.

16. Device as claimed in claim 1, wherein the nozzles have slit shaped apertures and are constructed and arranged to provide water jets that strike the surface to be cleaned in areas that are wider in a direction parallel to the radius of the rotary disc than in a direction perpendicular to the radius of the rotary disc member.

* * * * *